United States Patent [19]

Fitch

[11] 4,139,922

[45] Feb. 20, 1979

[54] CARPET CLEANING DEVICE

[76] Inventor: Chester Fitch, 247 Dover Ridge Close SE., Calgary, Canada

[21] Appl. No.: 825,917

[22] Filed: Aug. 19, 1977

[51] Int. Cl.[2] ..... A47L 5/34

[52] U.S. Cl. ..... 15/321; 15/340; 15/372

[58] Field of Search ..... 15/320, 321, 322, 340, 15/372

[56] References Cited

U.S. PATENT DOCUMENTS

| | | | |
|---|---|---|---|
| 1,333,226 | 3/1920 | Stoney | 15/320 X |
| 1,391,754 | 9/1921 | Bair | 15/320 X |
| 2,489,399 | 11/1949 | Claytor | 15/372 X |
| 2,622,254 | 12/1952 | Mendelson | 15/320 X |
| 2,731,659 | 1/1956 | Coplen | 15/320 |
| 3,218,876 | 11/1965 | Berger | 15/340 X |
| 3,774,262 | 11/1973 | Anthony et al. | 15/322 |
| 3,871,051 | 3/1975 | Collier | 15/321 |

*Primary Examiner*—Christopher K. Moore
*Attorney, Agent, or Firm*—Stanley G. Ade

[57] ABSTRACT

A reversible electric motor is mounted in a frame and is connected to front and rear rotary brushes mounted transversely in the frame adjacent the front of the machine with a transverse vacuum nozzle being situated between the brushes. A transverse spray nozzle bar is situated forwardly of the front brush and a further spray nozzle bar is situated rearwardly of the rear brush. A transverse ground engaging drive roller is mounted adjacent the rear of the machine and is also connected to the electric motor. A handle extends upwardly and rearwardly from the rear of the machine and carries controls for the electric motor and for the spray nozzle bars. The vacuum nozzle and the spray bars are connected by flexible hoses to a remotely situated solution tank and recovery tank unit which also includes a source of vacuum such as a vacuum cleaner. Hot water and detergent are sprayed onto the carpet through the spray nozzle assemblies in advance of one of the brushes depending upon the direction of movement of the machine and is brushed into the carpet pile and extracted together with loosened dirt, by the vacuum nozzle therebehind. The machine rides on the drive roller and the engagement of the brushes and vacuum nozzle with the carpet is controlled by the handle manipulated by the operator.

8 Claims, 6 Drawing Figures

CARPET CLEANING DEVICE

BACKGROUND OF THE INVENTION

This invention relates to new and useful improvements in carpet cleaning assemblies.

Conventionally, carpets are cleaned by so-called steam cleaning with or without the addition of a foaming type shampoo.

Usually these assemblies are relatively heavy and have to be dragged rearwardly by the operator so that the steam and shampoo can engage the pile and can be vacuumed therefrom. Because of the weight, they can only be used in one direction and have to be relatively narrow because of the excessive weight required.

Other types of carpet cleaning machines utilize a hand held wand with a foam dispenser and vacuum nozzle connected remotely to a solution tank and recovery tank unit. However, these require considerable pressure to be applied in order to ensure sufficient engagement with the pile of the carpet.

All of these devices whether they use brushes or not, suffer from several disadvantages.

The main disadvantage is the fact that foaming shampoo require post rinsing as the shampoo embeds within the fibres together with residual dirt and is extremely difficult to remove. If post rising is not undertaken, then this residual shampoo readily attracts further dirt so that the carpet requires frequent cleaning.

Furthermore, in order to remove the shampoo with or without post rinsing, excessive hot water or steam is utilized which often causes shrinking of the carpet and/or bleeding of the dye from the backing thereof.

SUMMARY OF THE INVENTION

The present invention overcomes these disadvantages by providing a device in the form of a carpet cleaning assembly adapted for use with a remotely situated solution tank and recovery tank unit which includes a source of vacuum. The carpet cleaning assembly comprises a frame, handle means extending upwardly and rearwardly from the rear of said frame for controlling said assembly, a source of power in said frame, a transversely situated vacuum nozzle mounted in said frame and operatively connectable to said source of vacuum, ground engaging drive wheels spanning said frame forwardly of the rear thereof, a transversely situated rotatable brush component in said frame one in front of and one behind said vacuum nozzle and a transversely situated spray bar assembly mounted in said frame adjacent each brush component and being connectable to said solution tank.

One of the important aspects of the device is the provision of switch means on the handle which may be used to reverse the direction of the motor and hence the movement of the assembly across the carpet. Although both brushes normally revolve concurrently, a spray bar assembly is provided adjacent each of the brushes and is controllable by the operator to feed hot water and a low foaming detergent to the spray nozzle in advance of the brush depending upon the direction of travel of the machine.

Another aspect of the invention is to provide a device of the character herewithin described which may include a transversely situated drive roller around which the machine balances being controlled by the operator grasping the handle so that the engagement of the brushes and the vacuum nozzle may be controlled within limits.

Yet another object of the invention is to provide a device of the character herewithin described which is light weight and easily movable so that a relatively wide machine can be utilized.

A yet further object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
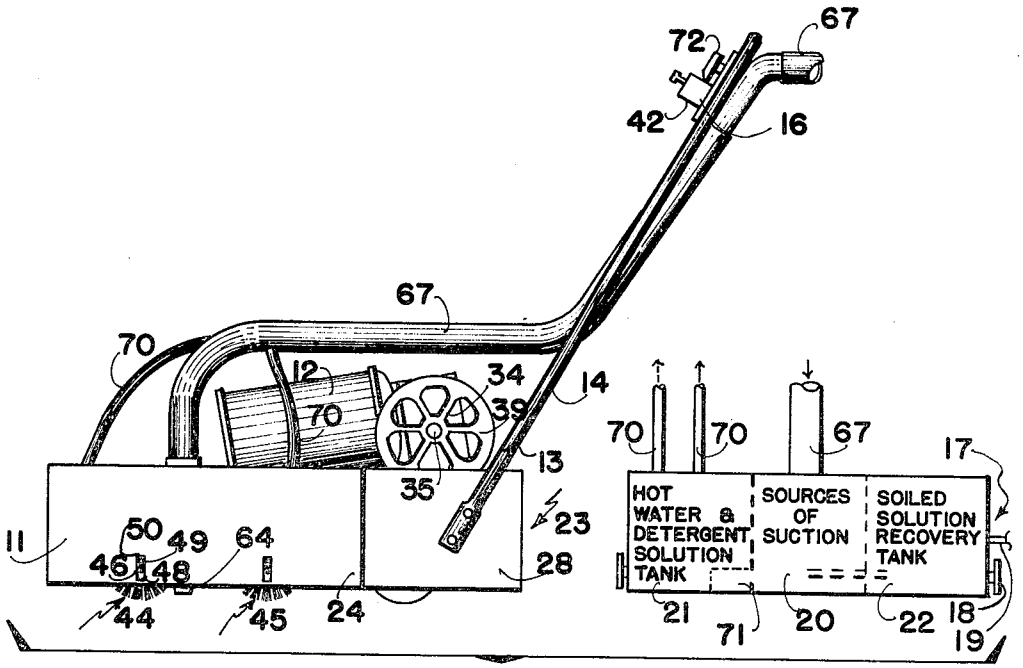
FIG. 1 is a side view of the machine showing a solution tank and recovery tank unit in schematic form.
Figure 2:
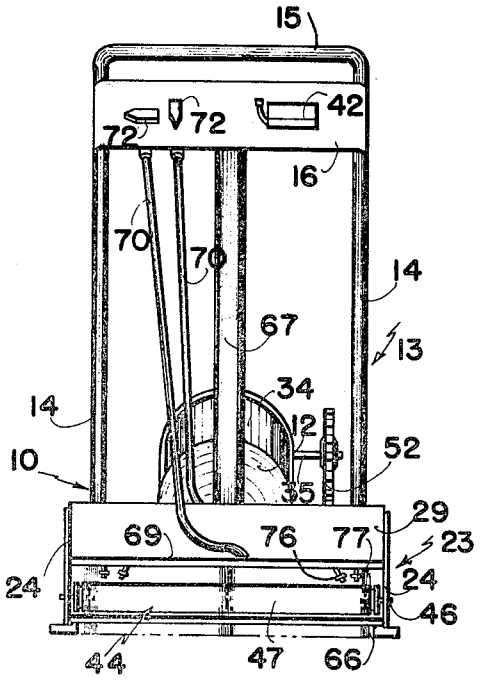
FIG. 2 is a front view of FIG. 1.

Proceeding therefore to describe the invention in detail, reference should first be made to FIGS. 1 and 2 which shows the machine collectively designated 10 including side covers 11, a source of power in the form of an electric motor 12 and upwardly and rearwardly extending handle component 13. This handle component includes the upwardly and rearwardly extending side members 14 connected to the side covers 11 and the upper cross bar 15 together with a control panel 16 spanning the side bars 14 adjacent the upper ends thereof.

Also shown in FIG. 1, in schematic form, is a conventional solution recovery tank assembly collectively designated 17 which is usually wheel mounted as at 18 and connected to a source of electrical power by means of a cable 19. It includes a source of suction in the form of a heavy duty vacuum cleaner 20, a hot water and detergent solution tank 21 and a soiled solution recovery tank 22 which is operatively connected to the vacuum cleaner 20 so that the soiled liquid picked up by the vacuum cleaner is deposited into the soiled solution recovery tank 22.

In detail, reference should be made to the remainder of the drawings in which reference character 23 illustrates a frame. This frame includes front spaced and parallel plate members 24 together with front spacer bar 25 extending therebetween. The rear ends of these members 24 are angulated inwardly as at 26 and secured to the out-turned angulated portions 27 of the rear frame members 28 which are also spaced and parallel and are maintained in this condition by means of the rear spacer bar 29.

Angle brackets 30 include out-turned portions 31 and forwardly extending spaced and parallel portions 32.

The out-turned portions 31 are secured to the portions 26 and 27 of the frame members 24 and 28 as by welding or by nut and bolt assemblies (not illustrated).

Figure 4:
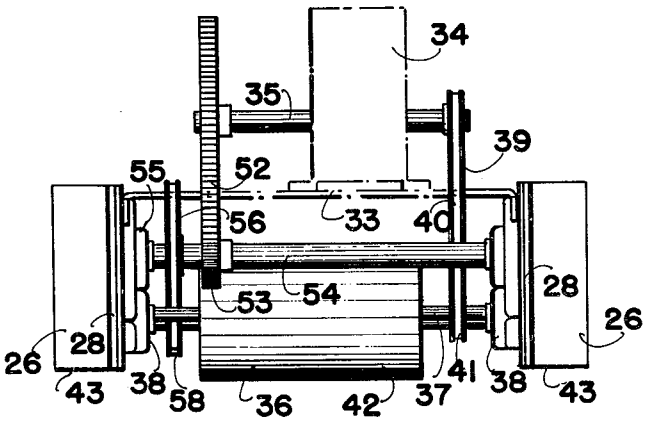
FIG. 4 is an enlarged partially fragmentary rear view of FIG. 3.

A support plate 33 is mounted within the frame and supports the aforementioned electric motor 12 to which a conventional speed reducer unit 34 is connected and a drive shaft 35 extends upon either side of the speed reducer as clearly shown in FIG. 4. A drive roller 36 secured to a shaft 37, is supported within the frame by means of bearings 38 journalling the shaft 37 for rotation between the frame members 28.

A sprocket 39 is secured to one end of the drive shaft 35 extending from the speed reducer 34 and a drive chain 40 extends around this sprocket 39 and around a further sprocket 41 secured to the shaft 37 carrying the drive roller 36 and it will be noted that the lower periphery portion 42 of this roller extends below the lower edge 43 of the assembly as clearly shown in FIG. 3.

A switch 44 (see FIG. 2) is mounted on plate 16 and is connectable to a source of electrical energy (not illustrated) by a conventional extension cord. This switch is also operatively connected to the electric motor 12 and is provided with three positions. The central position is the "off" position with a forward and reverse position being situated on either side thereof so that the direction of rotation of the motor 12 and hence the direction of rotation of the transversely situated roller 36 may be selected by the operator. By pushing downwardly on the handle, the assembly balances on the roller 36 so that movement forwardly or rearwardly can be selected.

A pair of transversely situated rotary brush components are provided collectively designated 44 and 45. Each rotary brush component includes a spindle 46 upon which is mounted a rotary brush element 47 and drive sprockets 48.

The side frame members 24 are provided with vertically situated closed ended slots 48' within which the ends of shaft 46 engage for vertical movement controlled by compression springs 49 reacting between the upper ends 50 of the slot and the upper surface 51 of the shafts 46 so that the brushes are in effect mounted for limited vertical floating action within the side plates 24.

These brushes are driven by the electric motor 12 by means of a gear 52 secured to the other end of shaft 35 extending from the speed reducer 34. This engages a smaller gear 53 secured to a shaft 54 journalled within bearings 55 which in turn are secured to the side plate members 28 of the frame 23.

A relatively large sprocket 56 is also secured to shaft 54 and a drive chain 57 extends around this sprocket and around a smaller sprocket 58 mounted upon a transverse shaft 59 journalled within bearings 60 which in turn are supported by the aforementioned spaced and parallel portions 32 of the angle brackets 30.

The shaft 59 extends beyond the angle brackets 30 and is provided with brush drive sprockets 61 upon either end thereof.

A brush drive chain 62 extends around these sprockets and around drive sprockets 63 secured to the ends of the shafts 46 carrying the brush components 47 so that the two brush components 44 and 45 are rotated in the same direction depending upon the position of the switch 42 on the handle plate 16.

Figure 3:
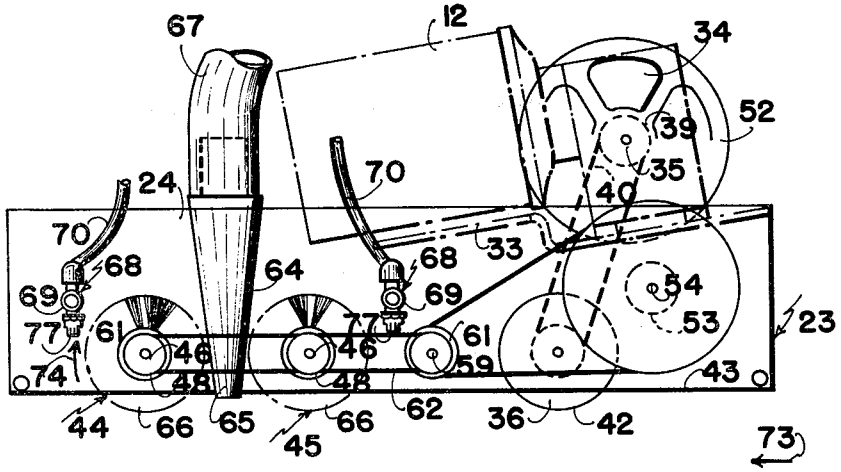
FIG. 3 is an enlarged side view of the machine with the handle removed and with the side cover removed.
Figure 6:
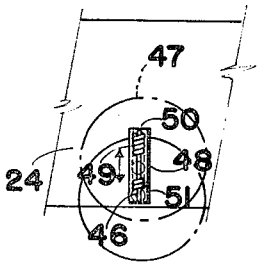
FIG. 6 is an enlarged fragmentary view showing the mounting of the brush assemblies within the frame.
Figure 5:
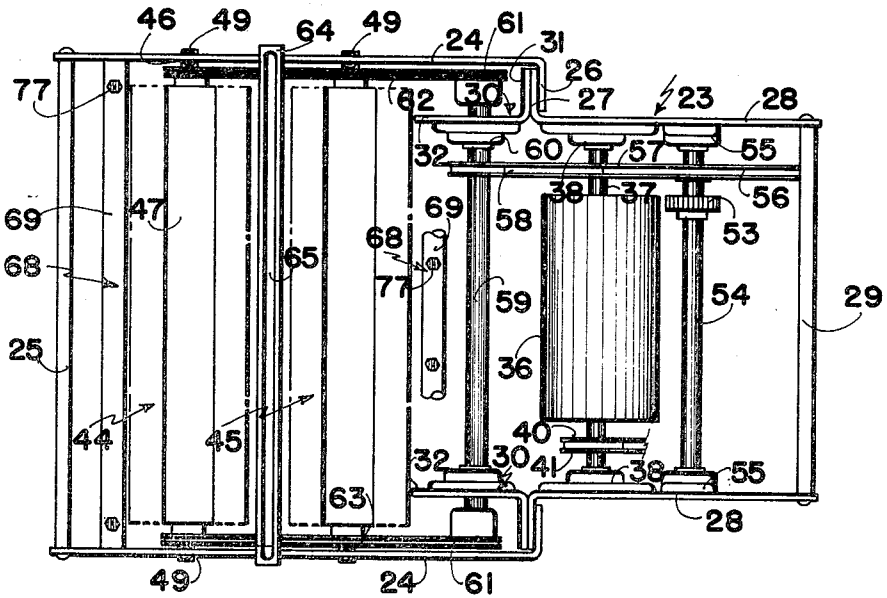
FIG. 5 is an underside view of FIG. 3.

A transversely situated vacuum nozzle 64 is situated within the frame between the two brush components, one of which is situated forwardly of this nozzle and one of which is situated rearwardly thereof as clearly shown in FIG. 3 and it will be noted that the lower entrance end 65 of this vacuum nozzle is in the form of a transversely situated elongated slot. The lower peripheries 66 of the brush components and the entrance slot 65 are substantially in the same plane and are below the lower side 43 of the assembly as clearly shown in FIG. 3.

The vacuum nozzle 64 is connected by means of a flexible hose 67, to the aforementioned vacuum cleaner 20 illustrated in FIG. 1.

A transversely situated spray nozzle assembly collectively designated 68 is mounted within the frame between side plate members 62 and is secured to these side plate members at either end of the spray nozzle assembly.

Each spray nozzle assembly includes a transversely situated manifold 69 which is connected via flexible tubes or hoses 70, to the hot water and detergent solution tank 21 shown in FIG. 1 and a pump shown schematically by reference character 71, supplies a mixture of hot water and detergent solution to either the spray nozzle assembly 68 situated in front of brush assembly 44 or to the spray nozzle assembly 68 situated to the rear of the brush assembly 45. The solution to the spray nozzle assemblies is controlled by means of hand operated valves 72 situated on the handle plate 16.

In operation, the switch 42 is actuated to move the machine in the desired direction. If, for example, it is moved in the direction of arrow 73 (FIG. 3) then the two brush assemblies 44 and 45 rotate in the direction of arrow 74 and the requisite valve 72 is opened to supply hot water and low sudsing detergent to the front spray nozzle assembly 68 situated forwardly of the brush assembly 44.

The machine is moved across the carpet by means of the drive roller 36 and the engagement of the nozzle 65 with the carpet, is controlled by the operator moving the handle and rotating the machine around the drive roller 36. The hot water and detergent is sprayed into the carpet pile and is engaged by the brush assembly 44 and is then vacuumed from the carpet by means of the vacuum nozzle 64. The springs 49 maintain the brush assemblies in close contact with the carpet so that the majority of the detergent and hot water together with extracted dirt, is picked up by the vacuum nozzle 64 through slot 65.

Side frame members 24 and 28 act also as side cover panels and cover each side of the machine together with the sprockets and chains situated inboard of the side frame members and a cover (not illustrated) encloses the gear 52 and the sprocket 39 together with chain 40.

Finally note should be taken of FIG. 2 in which at least one outer spray nozzle assembly 76 extending downwardly from the manifold 69, is directed downwardly and outwardly to facilitate coverage of the solution being sprayed therefrom and permitting ready overlap as the device is moved across the carpet being cleaned. The remainder of the spray nozzles 77 are directed downwardly as clearly shown in FIG. 2 and, of course, are secured to the manifold 69 and operatively connected therewith.

Advantages of the present device include the use of a hot water and low sudsing detergent together with the fact that it is portable and cleans forwardly and in a reverse direction readily and easily.

A brushing action is provided regardless of the direction being travelled together with a centrally located suction device thus enabling the device to clear to the carpet edges. The brushes are self-adjustable due to the floating action and the device is, of course, self-propelled by means of the drive roller 36.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A carpet cleaning assembly for use with a remotely situated solution tank and recovery tank unit including a source of vacuum; comprising in combination a frame, handle means extending upwardly and rearwardly from the rear of said frame for controlling said assembly, a source of power in said frame, a transversely situated vacuum nozzle mounted in said frame and operatively connectable to said source of vaccum, ground engaging drive means, spanning said frame forwardly of the rear thereof and being operatively connected to said source of power, two transversely situated rotatable brush components in said frame one in front of and one behind said vacuum nozzle also operatively connected to said source of power and a transversely situated spray bar assembly mounted in said frame adjacent each respective brush component and being connectable to said solution tank and valve means on said handle operatively connected between said spray bar assemblies and said solution tank for selectively controlling the connection between said solution tank and either one of said spray bar assemblies.

2. The assembly according to claim 1 in which each of said spray bar assemblies includes a manifold across said frame and a plurality of spray nozzles secured to the underside of said manifold and operatively connected thereto, at least one nozzle adjacent each end of said manifold being directed outwardly and downwardly therefrom.

3. The assembly according to claim 2 in which said ground engaging drive means comprises a roller journalled for rotation within said frame and being operatively connected to said source of power and switch means on said handle operatively connected to said source of power for controlling the stopping and starting of said roller and the direction of rotation thereof.

4. The assembly according to claim 3 in which each of said rotatable brush components includes a shaft, a rotary brush secured to said shaft and spanning said frame, a vertically slotted plate forming part of said frame adjacent each end of each of said brush components, the ends of said shaft of said brush components being mounted within said slots, and compression springs reacting between the upper ends of said slots and the ends of said shafts thereby mounting said brush components for limited vertical floating action within said frame.

5. The assembly according to claim 2 in which each of said rotatable brush components includes a shaft, a rotary brush secured to said shaft and spanning said frame, a vertically slotted plate forming part of said frame adjacent each end of each of said brush components, the ends of said shaft of said brush components being mounted within said slots, and compression springs reacting between the upper ends of said slots and the ends of said shafts thereby mounting said brush components for limited vertical floating action within said frame.

6. The assembly according to claim 1 in which said ground engaging drive means comprises a roller journalled for rotation within said frame and being operatively connected to said source of power and switch means on said handle operatively connected to said source of power for controlling the stopping and starting of said roller and the direction of rotation thereof.

7. The assembly according to claim 6 in which each of said rotatable brush components includes a shaft, a rotary brush secured to said shaft and spanning said frame, a vertically slotted plate forming part of said frame adjacent each end of each of said brush components, the ends of said shaft of said brush components being mounted within said slots, and compression springs reacting between the upper ends of said slots and the ends of said shafts thereby mounting said brush components for limited vertical floating action within said frame.

8. The assembly according to claim 1 in which each of said rotatable brush components includes a shaft, a rotary brush secured to said shaft and spanning said frame, a vertically slotted plate forming part of said frame adjacent each end of each of said brush components, the ends of said shaft of said brush components being mounted within said slots, and compression springs reacting between the upper ends of said slots and the ends of said shafts thereby mounting said brush components for limited vertical floating action within said frame.

* * * * *